US006340316B2

(12) United States Patent
Nagai

(10) Patent No.: US 6,340,316 B2
(45) Date of Patent: Jan. 22, 2002

(54) CONNECTOR AND SET OF CONNECTORS

(75) Inventor: Kentaro Nagai, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/575,722

(22) Filed: Aug. 4, 2000

(30) Foreign Application Priority Data

Aug. 6, 1999 (JP) ..... P11-224181

(51) Int. Cl.[7] ..... H01R 13/502; H01R 13/514
(52) U.S. Cl. ..... 439/701; 439/717
(58) Field of Search ..... 439/389, 409, 439/410, 701, 700, 594, 717, 541.5, 596, 367

(56) References Cited

U.S. PATENT DOCUMENTS 3,877,774 A * 4/1975 Dorrell ..... 439/410
4,834,669 A * 5/1989 Siemon et al. ..... 439/367
4,988,311 A * 1/1991 Tanzola ..... 439/389
4,995,830 A * 2/1991 Eckhaus ..... 439/409
5,675,890 A * 10/1997 Yamamoto et al. ..... 439/409

FOREIGN PATENT DOCUMENTS

JP 10-92508 4/1998

* cited by examiner

*Primary Examiner*—P. Austin Bradley
*Assistant Examiner*—Felix O. Figueroa
(74) *Attorney, Agent, or Firm*—Finnegan, Henderson, Farabow, Garrett & Dunner, L.L.P.

(57) ABSTRACT

A connector housing has an opening for pressure contacting an insulated wire to an insulation displacing terminal in a terminal accommodating chamber. A housing body has an upper wall and a lower wall one of which defines the opening. A cover is for closing the opening and is connected integrally to the housing body through a hinge. An engagement projection is fixed to an outer surface of the cover at a position opposite to the hinge. When a set of insulation-displacement connectors is joined, the engagement projection is fitted in an engagement recessed part formed on an opposing surface of a mating connector, so that the connector housing and the mating connector are joined with each other. Insulation-displacement connectors are stacked in a vertical direction and each has the engagement projection formed to the cover.

19 Claims, 3 Drawing Sheets

CONNECTOR AND SET OF CONNECTORS

BACKGROUND OF THE INVENTION

1. Field of the Invention

The invention relates to a connector and a set of connectors which is adapted to, for example, a vehicle.

2. Description of Relevant Art

There has been disclosed in Japanese Patent Application Laid-Open Publication No.10-92508 a set of connectors.

The set of connectors has a type in which insulation -displacement connectors are stacked in a plurality of steps. An upper connector housing is stacked on a lower connector housing. A cover covers an opening of an upper rear part in the upper connector housing, and all of them are integrally joined.

SUMMARY OF THE INVENTION

However, in the joined connector, an opening of a lower connector housing is closed by a bottom surface of an upper connector housing. There is prepared a cover for closing an opening in addition to connector housings for stacking in a vertical direction, so that there are a lot of parts separated each other. Flexible locking pawls for joining is provided to both of a left and a right sides of the connector housing and both of a left and a right sides of the cover, and there is a problem that a size of a transverse width is enlarged.

It is an object of the present invention to provide a connector and a set of connectors for reduction of a number of parts and for reduction of a size of a transverse width.

To achieve the object, a first aspect of the invention provides an insulation-displacement connector. A connector housing has an opening for pressure contacting an insulated wire to an insulation displacing terminal in a terminal accommodating chamber. A housing body has an upper wall and a lower wall one of which defines the opening. A cover is for closing the opening and is connected integrally to the housing body through a hinge. An engagement projection is fixed to an outer surface of the cover at a position opposite to the hinge. When a set of insulation-displacement connectors is joined, the engagement projection is fitted in an engagement recessed part formed on an opposing surface of a mating connector, so that the connector housing and the mating connector are joined with each other.

A second aspect of the invention provides a set of insulation-displacement connectors. Insulation-displacement connectors are stacked in a vertical direction and each has the engagement projection formed to the cover. The engagement projection is fitted in the engagement recessed part formed to the connector housing of the mating insulation-displacement connector. The insulation-displacement connectors adjacent to each other are joined.

Preferably, the engagement projection and the engagement recessed part each are formed in an elongated shape which crosses terminal accommodating chambers arranged in a transverse direction of a connector housing.

Preferably, the engagement projection and the engagement recessed part each are arranged at a rear end of the connector housing, another engagement part is provided at a front end of a connector housing, and engagement parts of insulation-displacement connectors adjacent to each other are engaged with each other, reinforce the engagement between adjacent insulation-displacement connectors.

A third aspect of the invention provides a cover-integrated connector. A housing body has an accommodating chamber for a terminal and has a first wall part covering the accommodating chamber and defining an opening for access. A cover has a distal end and a proximal end. The cover is connected to the first wall part at the proximal end thereof for pivoting. The cover is to pivots on the distal end to close the opening. The cover has a first engagement part for engaging with a first mating connector at the distal end thereof.

Preferably, the housing body has a second wall part covering the accommodating chamber. The second wall part is opposed to the first wall part and has a second engagement part for engaging with a second mating connector.

Preferably, the first engagement part extends in a transverse direction of the cover.

Preferably, the first wall part has a third engagement part extending in a longitudinal direction thereof for engaging with the first mating connector.

According to the inventions, in the connector, a cover is provided integrally to a connector housing, and a number of separated parts are reduced. An engagement projection is provided on the cover, and when the engagement projection is fitted in an engagement recessed part of a mating connector, a set of connectors is constituted. Because an engagement projection on a cover is employed for a finger mount, operations for closing and opening the cover is made easy. An engagement projection for joining adjacent insulation-displacement connectors is provided on an outer surface of the cover, and though lock parts are provided on right and left side parts, the engagement projection is arranged not to contact with the lock parts. Therefore, an excess engagement means does not need to be provided at left and right side parts of a connector housing, and a transverse size of a connector is to be reduced.

An engagement projection and an engagement recessed part each are formed in an elongated shape, and the joining force of the engagement projection and the engagement recessed part is applied to a wide range in a transverse direction of connector housings.

In a set of connectors, engagement parts at front ends of connector housings in addition to engagement parts at rear ends join connector housings to each other, and a firmly joining state through connector housings is maintained.

BRIEF DESCRIPTION OF THE ACCOMPANYING DRAWINGS

These and other features, aspects, and advantage of the present invention will become better understood with regard to the following description, appended claims, and accompanying drawings where:

DETAILED DESCRIPTION OF THE PREFERRED EMBODIMENTS

An embodiment of the invention will be explained with reference to drawings.

Figure 1:
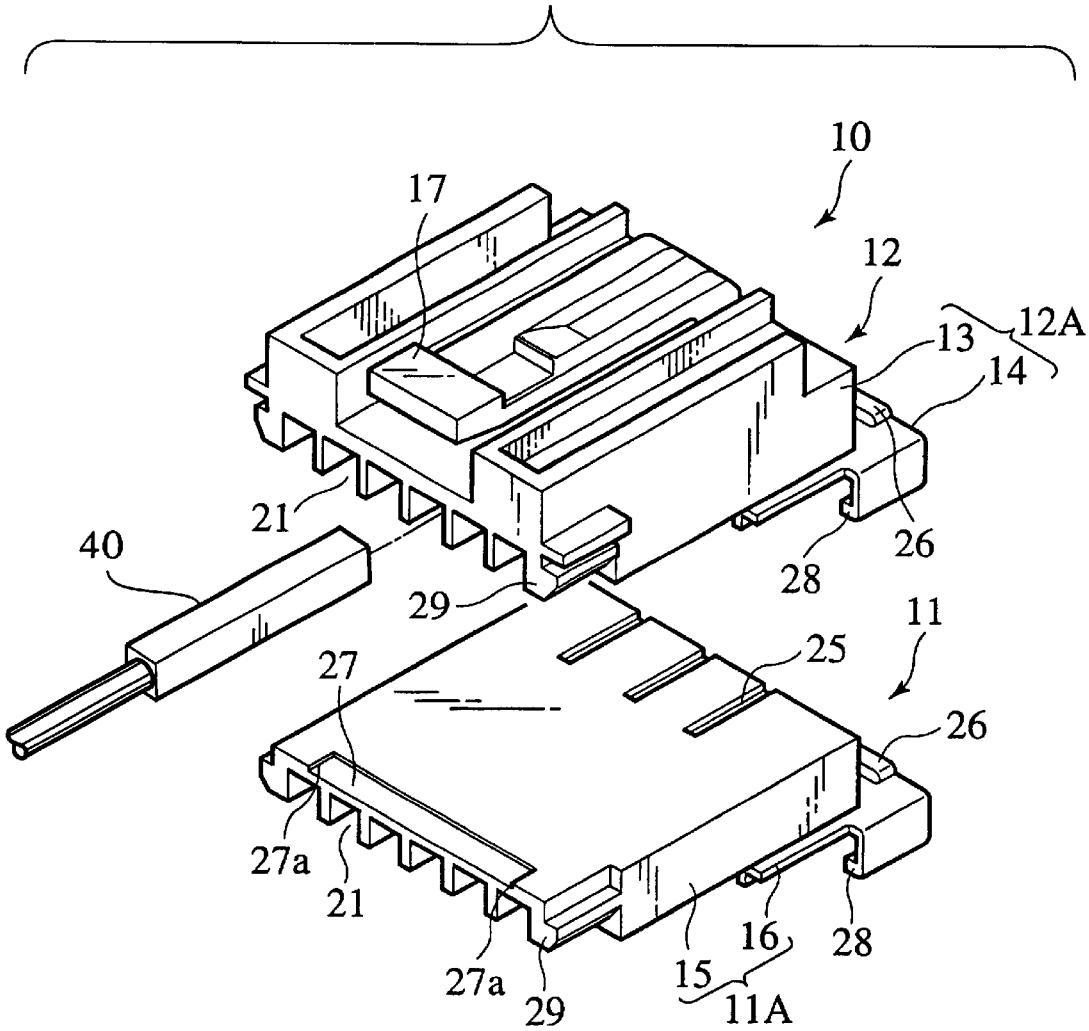
FIG. 1 is a perspective view of insulation- displacement type connectors of an embodiment according to the invention, which shows a state prior to joining adjacent insulation-displacement connectors if a set of connectors is constituted.

FIG. 1 is a perspective view showing a state before insulation -displacement connectors 11, 12 to be fitted to each other to configure a set of connectors 10 are fitted to each other.

The set of connectors 10 comprises two insulation-displacement connectors 11, 12 stacked one above another and connected to each other one, wires W being drawn out from the rear of connector housings 11A, 12A of the insulation-displacement connectors made of synthetic resin. The connector housings 11A, 12A of the respective insulation-displacement connectors 11, 12 comprise housing bodies 13, 15 and covers 14, 16 for closing lower face openings of the housing bodies 13, 15 (the lower faces are turned up when the wires are pressure contacted). The lower face openings are provided in order to perform working for pressuring contacting wires W to insulation-displacement terminals 40 which have been accommodated in terminal accommodating chambers 21 of the housing bodies 13, 15, and they are provided at rear half parts of the lower face walls of the housing bodies 13, 15.

The covers 14, 16 are for closing the openings after the wires W are pressed to the insulation-displacement terminals 40 to be contacted with, and they are connected integrally to the housing bodies 13, 15 through hinges 31. The hinges 31 are disposed between the front ends of the covers 14, 16 positioned when the openings have been closed and lower face walls of the front sides of the lower openings of the housing bodies 13, 15.

Locking parts 28 on the covers 14, 16 engageable with locking parts 29 on the housing bodies 13, 15 are provided at front end left and right side parts of the covers 14, 16, and they can lock the covers 14, 16 in a state where the openings of the housing bodies 13, 15 have been closed.

Also, engagement projections 26 are respectively provided on outer faces (faces are positioned outside when the openings are closed) at front ends (which are positioned at rear ends when the openings are closed) of the covers 14, 16 of the respective insulation-displacement connectors 11, 12, and an engagement recessed part 27 engaged with the engagement projection 26 is provided at a rear end upper face of the insulation-displacement connector 11 which is a lower stage. Each of the engagement projection 26 and the engagement recessed part 27 is formed in an elongated shape extending over a plurality of terminal accommodating chambers 21 arranged in a transverse direction of each of the connector housings 11A, 12A.

Figure 2A:
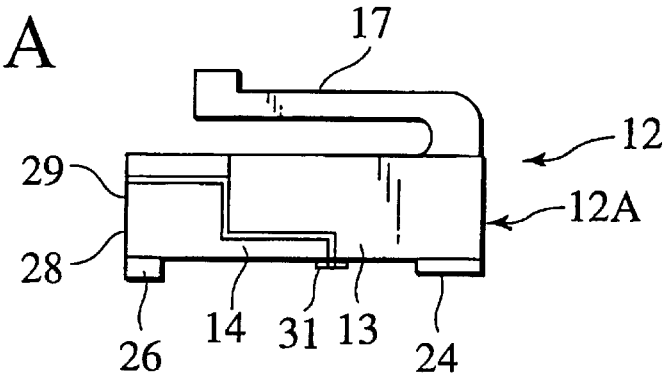
FIG. 2A is a side view of an insulation- displacement connector used by a single insulation-displacement connector.
Figure 2B:
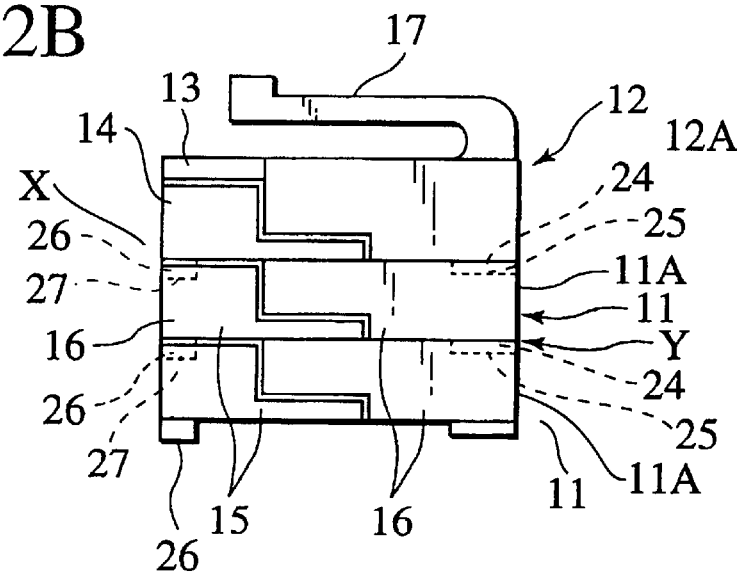
FIG. 2B is a side view of a set of connectors which is constituted of insulation-displacement connectors stacked in three steps.

FIG. 2A is a side view in a case where an upper connector 12 is used in a single manner, and FIG. 2B is a side view of an assembled connector in a case where an upper stage insulation-displacement connector 12 are connected with two lower stage insulation- displacement connectors 11 in a stacking manner.

Engagement parts 24, 25 of a recessed and projection type which are fitted to each other by pushing them in upward and downward directions are provided on opposed faces of front parts of the connector housings 11A, 12A to be stacked one above another. The engagement parts 24, 25 are structured as a dovetail joint. As shown in FIG. 3B, one engagement part 24 is formed in a "tenon" shape, and the other engagement part 25 is formed in a "mortise" shape. The former "tenon" shape engagement part 24 is formed on the lower faces of the housing bodies 13, 15 constituting the upper stage side connector housings 12A, 11A, and the latter "mortise" shape engagement part 25 is formed on the upper face of the housing body 15 constituting the lower stage side connector housing 11A.

In this case, the engagement parts 24, 25 of the dovetail joint are arranged a plurality of sets at intervals in transverse directions of the connector housings 11A, 12A. The upper and lower insulation-displacement connectors 12, 11 can be positioned in the transverse directions thereof by these engagement parts 24, 25.

Figure 3A:
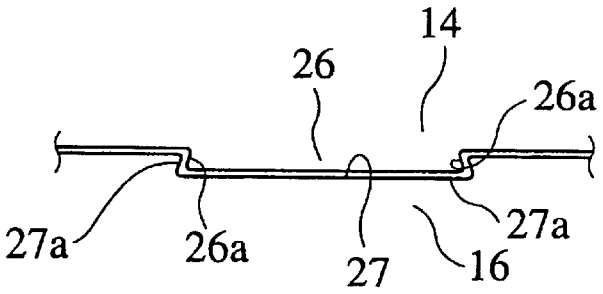
FIG. 3A is a side view of a portion arrowed by X in FIG. 2B.
Figure 3B:
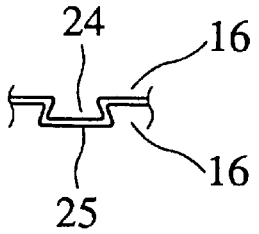
FIG. 3B is an enlarged side view of a portion arrowed by Y in FIG. 2B.

Also, the engagement projection 26 and the engagement recessed part 27 are constituted as a dovetail joint, as shown in FIG. 3A. In this case, slant surfaces 26*a*, 27*a* are provided on both ends, in the longitudinal direction, of the engagement projection part 26 of an elongated shape and the engagement recessed part 27.

Incidentally, the upper stage insulation-displacement connector 12 is always positioned at an upper stage, and the connector has on an upper face 12A a lock arm 17 which is locked with a lock arm of a mating connector when the connector 12 is fitted to the mating connector.

Next, an assembling procedure will be explained.

When the set of connectors 10 is assembled, first the individual insulation-displacement connectors 11, 12 are assembled and completed prior to joining them. That is, the insulation displacing terminals are set in the terminal accommodating chambers 21 of the connector housings 11A, 12A of the respective insulation-displacement connectors 11, 12, and wires are pressure contacted to respective insulation-displacement terminals through the openings. Next, the openings of the housing bodies 13, 15 are closed by the covers 14, 16 and the covers 14, 16 and the housing bodies 13, 15 are locked to each other by the locking parts 28, 29, so that the individual insulation-displacement connectors 11, 12 are completed in a single manner. When the covers 14, 16 are operated, the engagement projections 26 provided on the front end outer faces of the covers 14, 15 can be utilized as a finger mount so that closing operation of the covers 14, 16 can be easily performed. Incidentally, the engagement projection part 26 serves as a finger mount when the connector is fitted to or released from a mating connector, so that such an operation as fitting of a mating connector or the like is made easy.

Next, the upper stage insulation-displacement connector 12 is disposed on the lower stage insulation-displacement connector 11, and the upper stage insulation-displacement connector 12 is placed on the upper face of the lower stage insulation-displacement connector 11 while the engagement projection part 26 provided on the cover 14 of the upper stage insulation-displacement connector 12 is being fitting to the engagement recessed part 27 of the rear end upper face of the lower stage insulation-displacement connector 11. Then, the engagement part 24 of the "tenon" shape on the front part lower face of the upper stage connector housing 12A is engaged with the engagement part 25 of the "mortise" shape of the lower stage of the connector housing 11A by pushing down the upper stage insulation- displacement connector 12 strongly. Thereby, the set of connectors 10 of two stages can be completed.

In the set of connectors 10 thus structured, since each of the covers 14, 16 are provided integrally for each of the connector housing 11A, 12A, the number of parts separated can be reduced. Also, since the engagement part 26 for joining is provided on the outer face of each of the covers 14, 16, it does not obstruct the covers 14, 16 provided on the left and right side parts of the connector housings 11A, 12A and the lock parts 28, 29 of the housing bodies 13, 15, so that the size of transverse width of each of the insulation-displacement connectors can be reduced. Also, since the engagement projection part 26 and the engagement recessed part 27 each are formed in an elongated shape so as to extend over the plurality of terminal accommodating chambers 21, the joining force between the engagement projection part 26 and the engagement recessed part 27 can be applied to a wide range of the connector housings 11A, 12A in the transverse directions.

Incidentally, the upper stage insulation-displacement connector 12 constituting the set of connectors 10 can be used in a single manner, as shown in FIG. 2A. Also, as shown in FIG. 2B, the lower stage insulation-displacement connector 11 may be attached under it with another lower stage insulation-displacement connector 11 so that a set of connectors of three or more stages can be easily structured.

Figure 4:
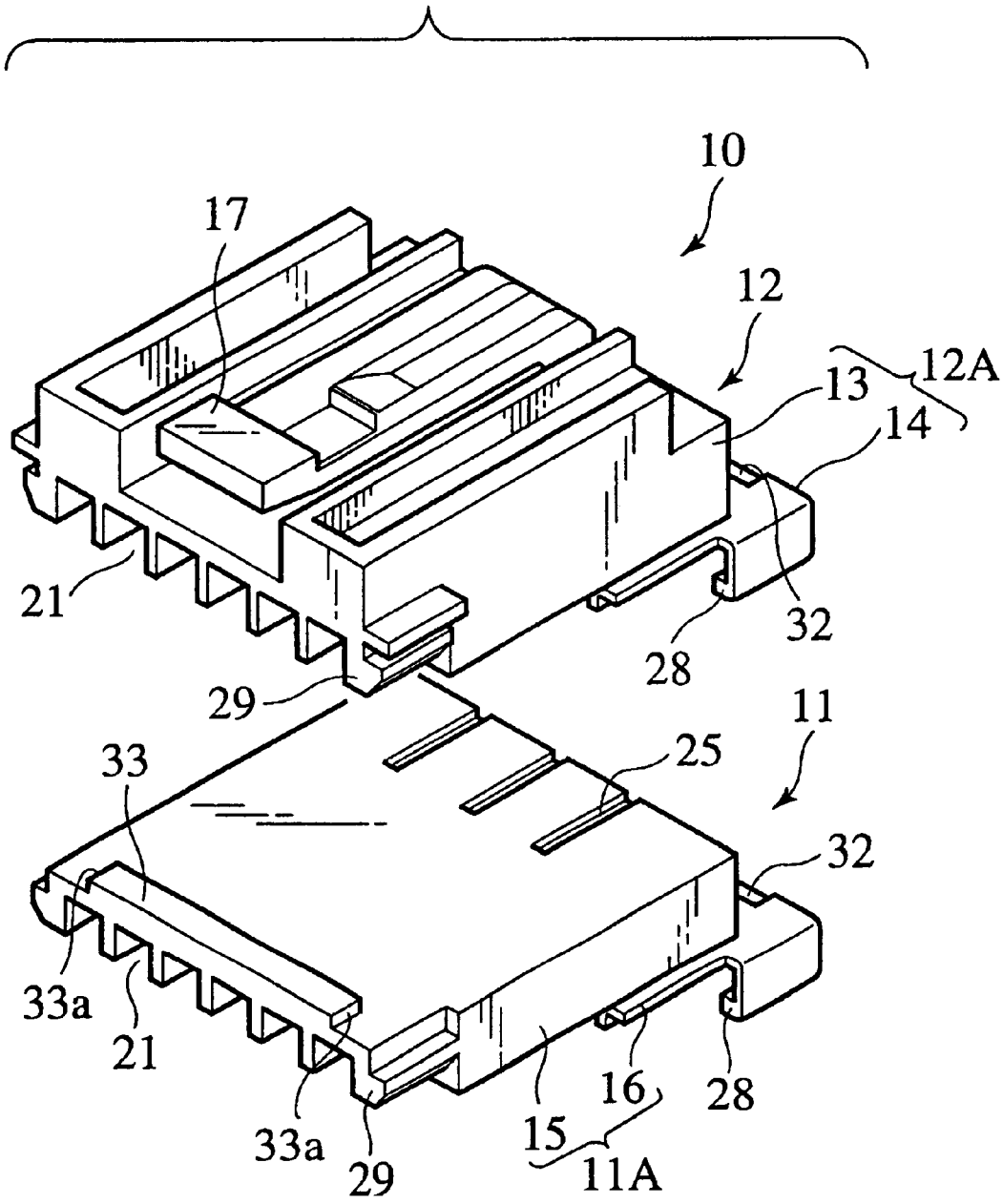
FIG. 4 is a perspective view of insulation-displacement type connectors of another embodiment according to the invention.

FIG. 4 shows another embodiment. Engagement recessed parts 32 are respectively provided on outer faces at front ends of the covers 14, 16. An engagement projection 33 to be engaged with the engagement recessed part 32 is provided at a rear end upper face of the insulation-displacement connector 11.

While preferred embodiments of the present invention have been described using specific terms, such description is for illustrative purposes, and it is to be understood that changes and variations may be made without departing from the spirit or scope of the following claims.

What is claimed is:

1. A plurality of insulation-displacement connectors, each of the plurality of insulation-displacement connectors comprising:

a connector housing having an opening for pressure contacting an insulated wire to an insulation displacement terminal in a terminal accommodating chamber, each connector housing comprising:

a housing body having an upper wall and a lower wall one of which defines the opening;

a cover for closing the opening, the cover being connected integrally to the housing body through a hinge; and a first engagement part fixed to an outer surface of the cover at a position opposite to the hinge, at least one of the plurality of insulation-displacement connectors comprising a first mating engagement part formed on a surface facing another of the plurality of insulation-displacement connectors, wherein, when at least one of the covers of the connector housings is closed, the engagement part of that cover of that connector housing of that insulation-displacement connector is fitted in the mating engagement part formed on the at least one of the plurality of insulation-displacement connectors to join at least two of the plurality of insulation-displacement connectors together.

2. The plurality of insulation-displacement connectors of claim 1 wherein the first engagement part and the first mating engagement part comprise a dovetail joint.

3. The plurality of insulation-displacement connectors according to claim 1, wherein the first engagement part has a projection, and the first mating engagement part has a recess.

4. The plurality of insulation-displacement connectors according to claim 1, wherein the first engagement part has a recess, and the first mating engagement part has a projection.

5. The plurality of insulation-displacement connectors of claim 1 wherein the plurality of insulation-displacement connectors are stacked in a vertical direction.

6. The plurality of insulation-displacement connectors according to claim 5, wherein, for each connector, each of the first engagement parts is provided at a rear end of the housing when the cover of that connector is closed and the first mating engagement part of the at least one of the plurality of insulation-displacement connectors is also provided at a rear end of the housing of that connector.

7. The plurality of insulation-displacement connectors according to claim 5, wherein each of said connector housings has a plurality of openings for pressure contacting a plurality of insulated wires to a plurality of insulation displacement terminals in a plurality of terminal accommodating chambers, wherein each of the first engagement parts is formed in an elongated shape which crosses the terminal accommodating chambers arranged in a transverse direction of the connector housings, and wherein the first mating engagement part formed on the at least one of the plurality of insulation-displacement connectors is also formed in an elongated shape which crosses the terminal accommodating chambers arranged in a transverse direction of the connector housings.

8. The plurality of insulation-displacement connectors according to claim 7, wherein, for each connector, each of the first engagement parts is provided at a rear end of the housing when the cover of that connector is closed and the first mating engagement part of the at least one of the plurality of insulation-displacement connectors is also provided at a rear end of the housing of that connector.

9. The plurality of insulation-displacement connectors of claim 6 or 8 wherein each of the covers comprises first and second locking parts on both a left side and a right side of each cover, wherein the locking parts lock each cover to close each opening of each housing body.

10. The plurality of insulation-displacement connectors of claim 6 or 8 wherein at least one of the plurality of connectors further comprises a second engagement part provided at a front end lower face of that connector housing and wherein at least one other of the plurality of connectors further comprises a second mating engagement part provided at a front end upper face of that connector housing, and wherein the second engagement part of the one connector is fitted into engagement with the second mating engagement part of the another connector to reinforce the engagement between at least two insulation-displacement connectors.

11. The plurality of insulation-displacement connectors of claim 10 wherein the second mating engagement part and the second engagement part comprise a dovetail joint.

12. The plurality of insulation-displacement connectors of claim 10 wherein the second mating engagement part and the second engagement part are arranged at a plurality of intervals in a transverse direction of the connector housings.

13. The plurality of insulation-displacement connectors according to claim 10, wherein the second engagement part has a projection, and the second mating engagement part has a recess.

14. An insulation-displacement connector comprising:

a connector housing having an opening for pressure contacting an insulated wire to an insulation displacement terminal in a terminal accommodating chamber, the connector housing comprising:

a housing body having an upper wall and a lower wall one of which defines the opening;

a cover for closing the opening, the cover being connected integrally to the housing body through a hinge; and a first engagement part fixed to an outer surface of the cover at a position opposite to the hinge, wherein the first engagement part is provided at a rear end lower face of the housing when the cover is closed; and a first mating engagement part provided at a rear end upper face of the connector housing.

15. The insulation-displacement connector of claim 14 wherein the first engagement part and the first mating engagement part each are formed in an elongated shape which crosses the terminal accommodating chambers arranged in a transverse direction of the connector housing.

16. The insulation-displacement connector of claim 15 further comprising a second engagement part provided at a front end lower face of the connector housing and a second mating engagement part provided at a front end upper face of the connector housing.

17. The insulation-displacement connector of claim 15 wherein the cover further comprises first and second locking parts on both a left side and a right side of each cover, wherein the locking parts lock each cover to close each opening of each housing body.

18. The plurality of insulation-displacement connectors according to claim 14, wherein the first engagement part has a projection, and the first mating engagement part has a recess.

19. The plurality of insulation-displacement connectors according to claim 14, wherein the first engagement part has a recess, and the first mating engagement part has a projection.

* * * * *